United States Patent [19]

Schraud et al.

[11] 3,943,613

[45] Mar. 16, 1976

[54] PROCESS FOR THE SHRINKING AND STRUCTURE DEVELOPMENTS OF TEXTILE WEBS AND THE LIKE

[76] Inventors: Alfred Schraud, Op de Bult, 2092 Moschen; Karl-Heinz Gottschalk, Schulenburgring 50, 2 Hamburg 80, both of Germany

[22] Filed: May 17, 1974

[21] Appl. No.: 471,099

[30] Foreign Application Priority Data

May 18, 1973 Germany ..... 2325215

[52] U.S. Cl. ..... 28/76 R; 8/137; 8/149.1; 8/149.3; 26/18.5

[51] Int. Cl.[2] ..... D06B 3/02; D06B 3/06

[58] Field of Search ..... 8/149.1, 149.3, 151, 151.2, 8/152, 137, 142, 116 R, 130.1; 26/18.5; 68/5 D, 5 E, 20; 28/76 R

[56] References Cited

UNITED STATES PATENTS

| | | | |
|---|---|---|---|
| 2,275,278 | 3/1942 | Andrews | 26/18.5 |
| 2,584,753 | 2/1952 | Spooner | 26/18.5 |
| 3,503,231 | 3/1970 | Fleissner et al. | 68/5 E |
| 3,730,679 | 5/1973 | Schuierer | 68/20 X |

*Primary Examiner*—Stanley N. Gilreath
*Assistant Examiner*—Philip R. Coe
*Attorney, Agent, or Firm*—Allison C. Collard

[57] ABSTRACT

A process for the shrinking and structure development of textile webs, particularly knitted goods or webs of textured synthetic yarns and the like, comprises the steps of subjecting the web under tension-free conditions to a first combined washing or cleaning and wet-shrinking and structure development treatment, then to a combined steam- and drying- shrinking and structure development treatment, and finally subjecting the web in flat-spread or spread-controlled condition to a drying-thermofixing or shrinking- and structure development and stabilizing treatment. Apparatus for performing said process includes means for wet treatment of the web, for treatment with steam, and drying means with tension-free guidance means, and a final stabilization and fixation chamber.

2 Claims, 1 Drawing Figure

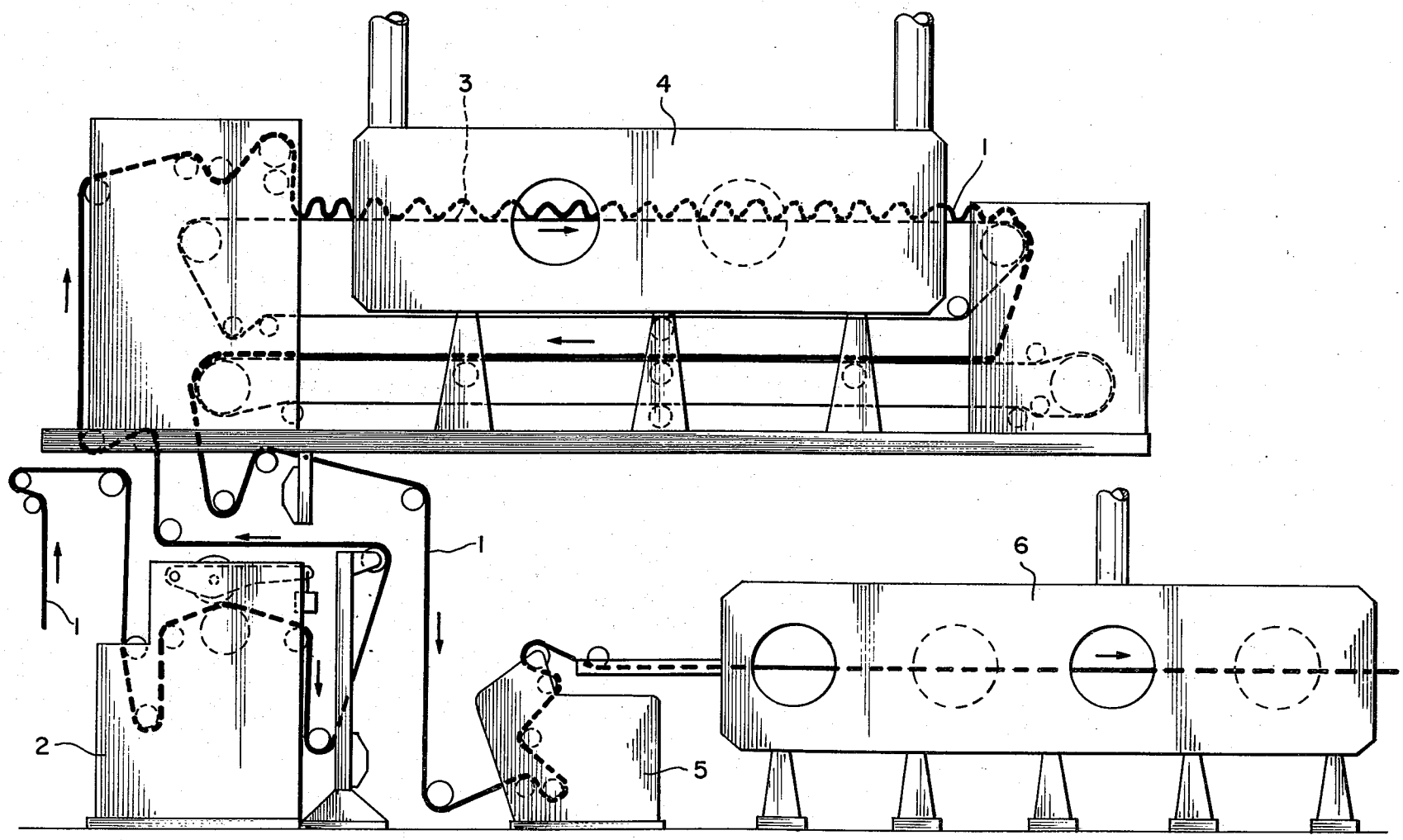
1
2
3
4
5
6

PROCESS FOR THE SHRINKING AND STRUCTURE DEVELOPMENTS OF TEXTILE WEBS AND THE LIKE

BACKGROUND OF THE INVENTION

The invention relates to a process for the shrinking and structure development of textile webs, particularly knitted goods, webs of textured polyester yarns, and the like, and also to apparatus for performing the process.

For the production of the optimum output of goods it is essential that the goods, either before or after final finishing, be shrunk as much as possible, in order to avoid a subsequent contraction during further processing or handling, and especially to achieve, in the case of textured goods, an optimum structural and volume development. Both processes are closely related in the case of textured fabric webs.

When, for example, circular knitted goods made from textured polyester yarns are washed, shrunk and thermofixed, it was customary in the prior art always to proceed so that the knitted goods were first washed in a special washing machine, namely, one equipped with a suction screen, then the goods were subjected to a shrinking operation in a holding chamber, such as a loop suspension chamber, a boiling apparatus, or a boiling or steaming apparatus with a wrinkling section, after which wringing, drying and thermofixation took place in special apparatus.

In these known methods, in which the thermofixation step is always performed on flat-spread webs, and the drying step is always carried out on flat-spread webs in hot air, it is not possible to attain a sufficiently high moisture content of the treatment medium economically in the drying or fixing chambers.

DESCRIPTION OF THE INVENTION

The present invention has as its object to achieve an improvement in the shrinking effect and in the structure development of goods of the character described, whereby a considerable part of the shrinking process is combined with the drying process, and is separate from the thermofixation, that is, the stabilizing structural development operation.

To achieve this objective, in accordance with the invention, there is provided a process in which the textile web, initially guided under absence of tension, especially lateral tension, immediately following a combined washing or cleaning and wet-shrinking and structure development treatment step, is further subjected to a combined steam- and dry-shrinking and structure development treatment, and then finally, in flat-spread or spread-controlled condition, is subjected to a drying-thermofixing or shrinking and structure development and stabilizing treatment.

It has been found suitable for this purpose to carry out the combined steam- and drying-shrinking and structure development treatment by passing the textile web in a tension-free condition through the process to complete final drying. The combined steam- and drying treatment should be performed in a common operation (single stage) as a drying in clean superheated steam or in a superheated steam-air mixture with a steam content of at least 75% by volume or greater, wherein the steam temperature is advantageously about 140° to 160° C.

Shifting the aforementioned processes to a low-tension or tension-free dryer has the advantages that the drying process can be carried out at a goods temperature of about 85° to 95°C, instead of the 45° to 60°C temperature previously employed; whereby under the action of moisture and elevated temperature an improved shrinking and washing effect is produced, and further that the goods can shrink freely because of the elimination of tension and extensive forward movement of the goods. In this manner there is produced a considerable improvement in the shrinking effect and the regulation of the process is simplified, since the previous fixed introduction of the textile web and passage of the goods through the dryer is no longer required, and fewer problems arise in the following stretching machines.

A suitable apparatus for performing the process of the present invention comprises a moisturizing unit, such as a special washing machine, a steam treatment unit, a special dryer equipped with tension-free goods guiding means, and finally a stabilizing-fixing tentering frame. It has been found advantageous to construct the moisturizing unit and the dryer, not as separate units, but to combine them in a treating means comprising a traveling screen dryer with a high steam capacity. In accordance with a preferred embodiment of the apparatus of the invention the final stage fixing chamber is equipped with a tentering frame having a weight releasing goods guide, for example, a dashpot arrangement, well known in the art.

The construction and operation of the apparatus and process of the invention will be better understood by reference to the accompanying drawing, in which:

The single FIGURE is a side elevational view of the apparatus showing the relationship of the various parts.

Referring to the drawing, the apparatus comprises a wet treatment unit 2 from which the textile web 1 leaves in folds on traveling screen 3 of a traveling screen dryer 4. In this traveling screen dryer there is maintained a steam atmosphere containing at least 75 percent by volume of steam, the temperature of which is about 150°C. In consequence of the tensionless passage of textile web 1 on the traveling screen 3, the goods can be led freely through all the units with shrinking and simultaneous drying, which can be carried to such a point that the textile web is completely dry when it leaves the dryer. It then passes over intake means 5 into final stage fixing chamber 6, in which it is treated with a hot air atmosphere at about 160° to 220°C.

It is within the contemplation of the invention that a definite fixation of textile web 1 is attained by the end of dryer 4, so that a definite overlapping of the drying and fixing operations results.

What is claimed is:

1. Process for the shrinking and structure development of textile webs, particularly knitted goods or webs of textured synthetic yarns and the like, comprising the steps of:

a. subjecting the textile web, under tension-free, and especially lateral-tension-free guidance to a combined washing or cleaning and wet-shrinking and structure development treatment;

b. then subjecting the textile web to a simultaneous steam- and drying-shrinking and structure development while guiding the tension-free or lateral-tension-free textile web to a point of complete dryness by drying with clean superheated steam or a superheated steam-air mixture having a steam content of at least about 75% by volume; and c. finally subjecting said web in flat-spread or spread-controlled condition to a simultaneous drying-thermofixing and shrinking- and structure development and stabilizing treatment.

2. The process of claim 1 in which the combined steam- and drying treatment of step (b) is carried out in superheated steam at a temperature of about 140° to about 160°C.

* * * * *